United States Patent [19]

Lawrence et al.

[11] 3,953,903

[45] May 4, 1976

[54] SPRING UNIT SUPPORT AND ASSEMBLY

[75] Inventors: James Rogers Lawrence; Chester R. Yates, both of Carthage, Mo.

[73] Assignee: Steadley Company, Inc., Carthage, Mo.

[22] Filed: Dec. 23, 1974

[21] Appl. No.: 535,987

[52] U.S. Cl. ..... 5/267; 5/276

[51] Int. Cl.[2] ..... A47C 23/02

[58] Field of Search ..... 5/266, 267, 273, 276, 5/351

[56] References Cited

UNITED STATES PATENTS

| | | | |
|---|---|---|---|
| 3,063,472 | 11/1962 | Winters | 5/276 |
| 3,774,248 | 11/1973 | Huras | 5/267 |
| 3,864,765 | 2/1975 | Anonauer | 5/267 |

*Primary Examiner*—Casmir A. Nunberg
*Attorney, Agent, or Firm*—Lee & Smith

[57] ABSTRACT

A coil spring supporting grid structure of the type used to reinforce the top surface of a box spring foundation unit is provided with formations on the longitudinal and transverse wires thereof, enabling a snap-in interconnection with a plurality of coil springs to form a spring unit assembly. Each coil spring convolute engaged by the grid structure is supported on a pair of upwardly extending formations from a pair of spaced parallel first wires and is locked in place by means of two downwardly depending formations from a pair of spaced parallel second wires which extend transversely with respect to the first wires to form the grid.

13 Claims, 5 Drawing Figures

SPRING UNIT SUPPORT AND ASSEMBLY

BACKGROUND OF THE INVENTION

This invention relates to a coil spring supporting grid structure and to a spring unit assembly of the type used in mattresses, foundation units or other items of upholstered furniture.

The present invention will be described in connection with a box spring or foundation unit, but it will be appreciated that the invention has application to other spring unit assemblies where a snap-in connection is desired between the springs and the surface reinforcement structure.

In the assembly of a box spring foundation unit, the coil springs are mounted on a wooden frame and then a top reinforcing and spring supporting structure, consisting of an outer border wire and a multiplicity of intermediate wires or bands, is laid on the top of the coil springs and attached by means of clips, pigtail wires or the like. Various alternative means for attaching the top surface supporting assembly to the springs have been proposed, such as, for example, bending portions of the top convolutes of the coil springs around the traversing wires, or, conversely, bending portions of the traversing wires around the top convolute of the coil springs. The foundation unit thus assembled is usually then shipped to the mattress factory where the upholstery is put on the unit.

The assembling of the box spring by applying hog rings, pigtail wires, clips, or by deforming portions of either the coil spring or the traversing wires of the surface support is an expensive and tedius operation involving considerable cost either in material, or in the amount of labor involved in the assembly operation, or both. In addition, since the assembly operation requires some skill and expertise, it can usually be done only by the spring manufacturer, which means that the unit must be shipped to the mattress company only after it has been fully assembled by the spring company. Such shipment of box springs in the assembled condition is very expensive. In an effort to reduce the expense of shipping the assembled product, companies have resorted to shipping the assembled units under compression in order to save space. This increases the cost of packaging and is somewhat dangerous, because care must be taken in removing the compressive force when uncrating the box springs. However, even when compressive force is used, there is a considerable amount of wasted space in the box spring package.

It is, of course, recognized that if the springs and the surface reinforcing structures could be packaged separately, there would be a substantial saving in the space required to ship the box spring and the shipping costs could be reduced. However, the box springs would then have to be assembled at the mattress factory. As a result, there have been various suggestions in the past with respect to facilitating the interconnection between the coil springs and the surface reinforcing structure or structures. However, these suggestions have involved either a forming operation or an assembly operation which requires additional wires, clamps or the like for attaching the coils to the top supporting assembly.

It is an object of this invention to provide a coil spring supporting grid structure which is adapted for snap-in interconnection with the coil springs, thereby avoiding the expense of additional materials for clamping or tying the coil springs to the supporting structure and minimizing the time and skill necessary in the assembly operation. Because the structure provides a firm, reliable and fast interconnection without requiring additional material, there is a saving in the cost of material, in the cost of assembly, and in the cost of shipping. The components of the structure may be shipped separately, with the coils nested, there can be approximately a 50% saving in space, and it is not necessary that the coils be placed under compression.

SUMMARY OF THE INVENTION

The invention features a novel coil spring supporting grid structure which is adapted for snap-in interconnection with a plurality of coil springs to form a novel spring unit assembly. In accordance with one aspect of the invention, the grid structure comprises a set of longitudinal and a set of transverse wires which are joined together and preferably welded at their intersections to define a substantially planar grid. The wires have coil-engaging formations intermediate the intersections which extend transversely with respect to the grid plane. The wires are so spaced that each coil will be engaged by a pair of longitudinal wires and a pair of transverse wires. Each corresponding pair of coil-engaging formations in the adjacent pair of longitudinal wires extends in one direction with respect to the grid plane, and each corresponding pair of coil-engaging formations in the adjacent transverse wires extends in the opposite direction with respect to the plane. In this manner, an end convolution of a coil spring is snapped in place under one corresponding pair of coil-engaging formations and over the other corresponding pair of formations.

It is preferred that the coil-engaging formations be displaced portions of the longitudinal and transverse wires, and that the distance between the pairs of longitudinal and pairs of transverse wires which are adapted to engage the coils be less than the diameter of the end convolute of the coils to be engaged so that the wires will respectively extend across portions of each coil as a chord.

The coil-engaging formations preferably have at least their end sections angularly disposed with respect to both the grid plane and the direction of displacement, so that they may wedgingly engage the coil spring convolution, and it is preferred that the intermediate portion between the opposing end sections of the formations be rectilinear and substantially parallel to the grid plane. The overall length of the coil-engaging formations should be greater than the root of $\sqrt{D^2 - S^2}$; where D is the diameter of the convolute of the coil spring to be engaged, and S is the distance between the displaced portions of the adjacent parallel coil-engaging wires. It is also preferred that the rectilinear intermediate section of the coil-engaging formation be of a length less than the root of $\sqrt{D^2 - S^2}$. This insures that a wedging action against the engaged convolute of the coil spring will take place.

Additionally, it is preferred that at least one set of the parallel wires be recessed on either side of the formation in order to accommodate the intersecting portions of the coil spring convolute, thereby bringing the coil spring convolute as nearly as possible into the grid plane.

DETAILED DESCRIPTION OF THE PREFERRED EMBODIMENT

Figure 1:
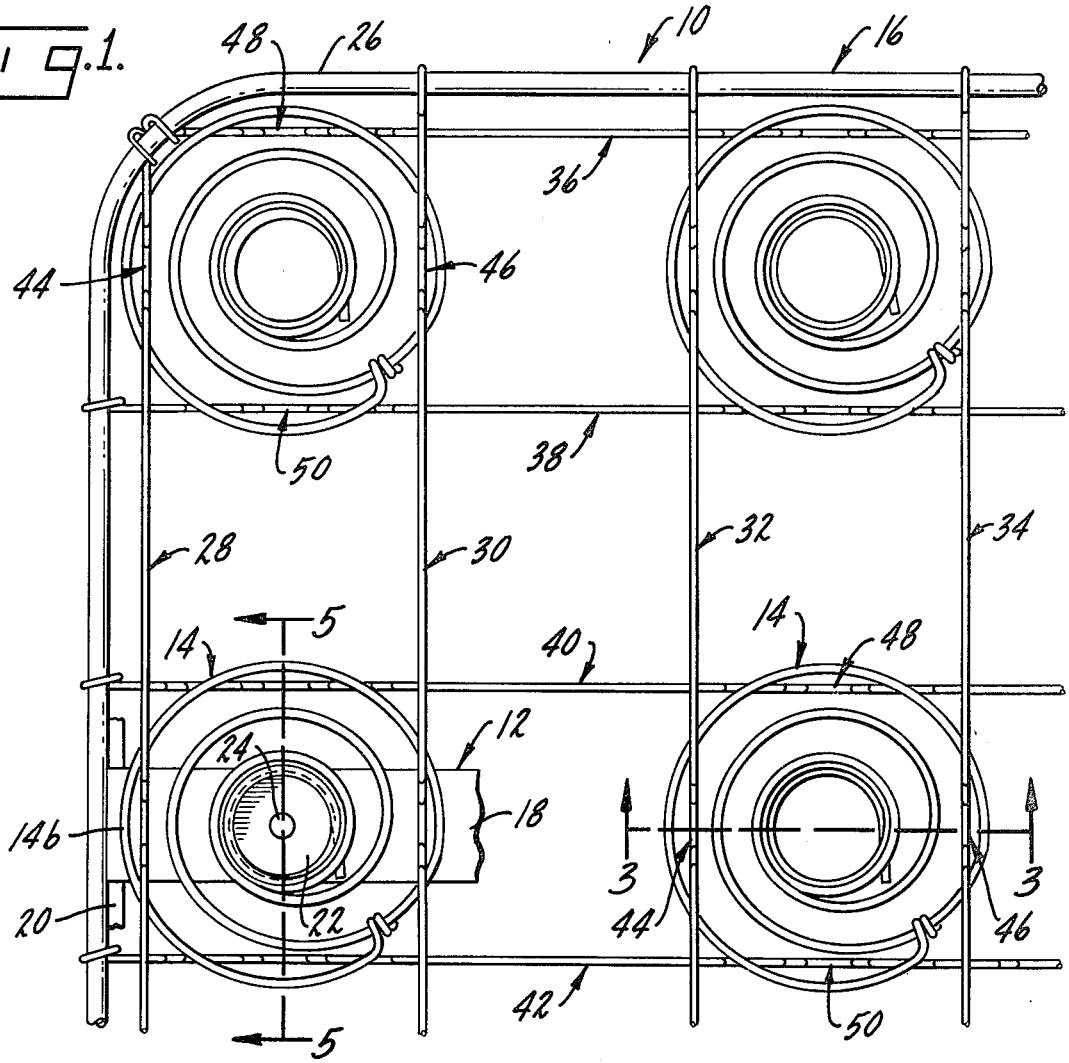
FIG. 1 is a top plan view of a portion of a spring unit assembly incorporating a coil spring supporting grid structure constructed in accordance with this invention.

In FIG. 1, there is shown portions of a spring unit assembly 10 which in this instance is a box spring foundation unit consisting of a bottom frame 12, a plurality of coil springs 14, and a top frame in the form of a coil spring supporting grid structure 16.

The bottom frame 12 may be of conventional wooden construction, having a plurality of transversely extending coil supporting members 18 which are attached to and extending between the longitudinal side rail 20 of the bottom frame.

The coil springs 14 also may be of conventional configuration, one form of coil spring being shown for illustrative purposes only. The bottom convolute 14*a* of each coil spring is attached by suitable means to the transverse supporting members 18 of the bottom frame 12. In the illustrated embodiment, this attachment is by means of a disc 22 having a recessed body portion which engages the bottom convolute 14*a* of the coil spring 14 and is attached to the transverse frame member 18 by means of a penetrating fastener 24. This means of attachment is shown for illustrative purposes only, and various other means can be utilized for attaching the bottom convolute 14*a* of each of the coil springs to the bottom frame member 12. The coil springs in this embodiment are arranged in spaced longitudinal columns and spaced transverse rows.

Each of the coil springs 14 has a substantially circular top convolute 14*b* which is adapted to be attached to the top frame or coil spring supporting grid structure 16, in a manner which will be more fully hereinafter described. In the illustrated embodiment, the grid structure thus serves as a top surface reinforcement. It will be appreciated that the same type of structure may be employed at the bottom of the box spring in place of the wooden bottom frame 12, although this is not preferred.

Figure 4:
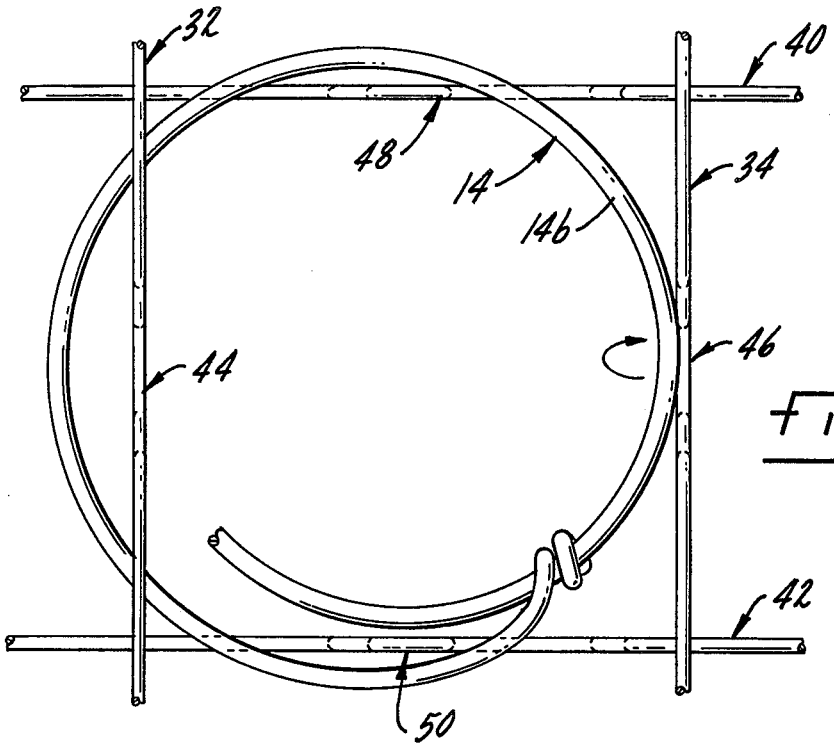
FIG. 4 is a top plan view of a portion of the coil spring supporting grid structure, showing the manner in which the top convolute of a coil spring is snapped into place to effect interconnection therewith.

The grid structure 16 comprises an outer border wire 26 which extends around the periphery of the spring unit assembly at the top. Attached to and extending parallel to one another in a first direction, which may be considered the longitudinal direction, is a first, or longitudinal, set of grid wires, four of which are shown in FIG. 4 and designated by the numerals 28, 30, 32 and 34. In this embodiment, there are two longitudinal grid wires for each longitudinal column of coil springs. Attached to the outer border wire 26 and extending transversely and preferably perpendicularly to the grid wires 28, 30, 32 and 34 is a second, or transverse, set of grid wires, four of which are illustrated in FIG. 1 and designated by the numerals 36, 38, 40 and 42. In this embodiment, there are two transverse grid wires for each transverse row of coil springs. The longitudinal and transverse grid wires are joined at their intersections, preferably by welding, thus forming a unitary, relatively rigid grid structure and lying substantially within a plane which will be designated the "grid plane", and is defined by the points of intersection of the longitudinal and transverse grid wires.

The top convolute 14*b* of each coil spring is adapted to be engaged by a pair of longitudinal grid wires and by a pair of transverse grid wires, the spacing between each pair of longitudinal and transverse grid wires being less than the diameter of the top convolute. Thus, the grid wires extend across the engaged convolute, as best illustrated in FIG. 1 where there are four coil springs 14 illustrated. As has been stated, the coils are aligned in spaced longitudinal columns and in spaced transverse rows. The spacing between the columns and rows of coil springs will thus determine the spacing between the adjacent pairs of coil springs engaging wires. Thus, the distance between longitudinal wires 30 and 32 is governed by the spacing between adjacent columns of coil springs, and the distance between transverse wires 38 and 40 is governed by the spacing between adjacent transverse rows of coil springs. However, the spacing between the wires of each coil engaging pair of wires is governed by the diameter of the top convolute of the coil springs to be engaged. Thus, the distance between longitudinal wires 28 and 30, the distance between longitudinal wires 32 and 34, the distance between transverse wires 36 and 38, and the distance between transverse wires 40 and 42 are all less than the diameter of the top convolute 14*b* of a coil spring 14.

Each pair of coil engaging longitudinal wires has a pair of opposed coil engaging formations 44 and 46 for each coil spring 14 which is engaged. These formations 44 and 46 extend in one direction with respect to the grid plane, which in the illustrated embodiment is downwardly from the grid plane. In the same manner, each pair of coil engaging transverse wires has a pair of opposed coil-engaging formations 48 and 50 for each coil spring 14 to be engaged. The formations 48 and 50 extend in the opposite direction with respect to the grid plane, which in the illustrated embodiment is upwardly from the grid plane.

Figure 2:
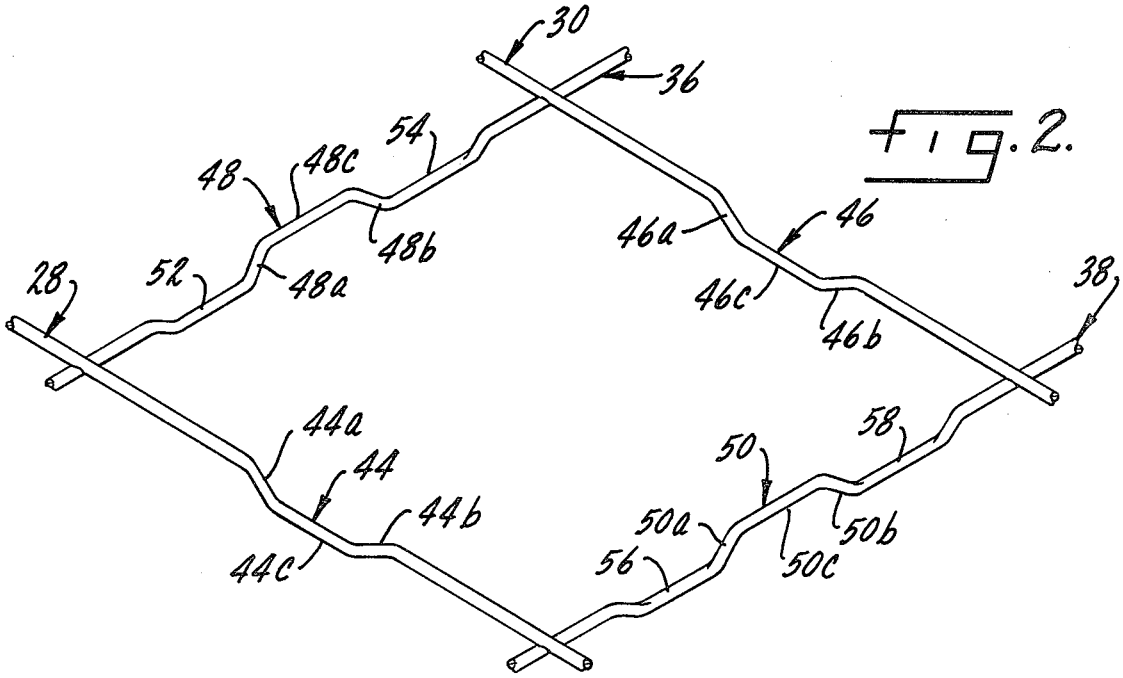
FIG. 2 is an enlarged perspective view of a portion of the coil spring supporting grid structure of this invention.

It is preferred that the formations 44 and 46 and the formations 48 and 50 be formed by displacing portions of the grid wires downwardly in the case of formations 44 and 46 and upwardly in the case of formations 48 and 50. This is best illustrated in FIG. 2. As may be seen from FIG. 1, the top convolute 14*b* of each coil spring 14 is positioned substantially in the grid plane with portions of the convolute disposed below the longitudinally extending grid wires and other portions of the convolute disposed above the transversely extending grid wires. Thus, the top convulute of the coil shown in the upper left hand corner of FIG. 1 is positioned under the downwardly extending coil-engaging formations 44 and 46 of the longitudinal grid wires 28 and 30, respectively, and this convolute is positioned over the upwardly extending coil-engaging formations 48 and 50 of the transverse grid wires 36 and 38, respectively.

In order to accommodate the top convolute 14*b*, it is preferred that one pair of the parallel wires be recessed on either side of the coil-engaging formation. In the illustrated embodiment, this is accomplished by providing recesses 52 and 54 on either side of the coil-engaging formation 48 in the transverse grid wire 36, and corresponding recesses 56 and 58 on either side of the coil-engaging formation 50 in the transverse wire 38. This is best illustrated in FIG. 2. The depth of the recesses 52 and 54 and 56 and 58 is preferably equal to the thickness of the wire used to make the coil spring, so that the top of the coil spring convolute will substantially coincide with the plane defined by the intersections of the longitudinal and transverse wires in the grid. With this contruction, the longitudinal wires will not be forced upwardly and the transverse wires will not be forced downwardly from their normal position by engagement with the coil spring top convolute.

It is preferred, however, that there be a wedging action between the coil-engaging formations of the transverse and longitudinal wires of the grid and the coil spring top convolute. In order to provide this wedging action, the coil-engaging formations are provided with angularly disposed end sections. Thus, the downwardly depending coil spring engaging formation 44 of longitudinal grid wire 28 has end sections 44*a* and 44*b* which are angularly disposed with respect to both the grid plane and the direction of displacement, these two sections being separated by an intermediate, substantially rectilinear section 44*c* which is preferably substantially parallel to the grid plane. In like manner, the downwardly depending formation 46 of the longitudinal grid wire 30 has angularly disposed end sections 46*a* and 46*b* and a rectilinear intermediate section 46*c*. The upwardly extending coil-engaging formations are similarly contructed, with formation 48 in the transverse grid wire 36 having end sections 48*a* and 48*b* separated by a rectilinear intermediate section 48*c*, which is substantially parallel to the grid plane. Similarly, the upwardly extending coil-engaging formation 50 of the transverse grid wire 38 has end sections 50*a* and 50*b* separated by a rectilinear intermediate section 50*c*, which is parallel to the grid plane. It should be noted that the upward extension of the intermediate sections 48*c* and 50*c* of the upwardly extending coil-engaging formations 48 and 50, respectively, extend above the grid plane in the preferred embodiment, and it is preferred that the extension be such as to place the top surface of the formations 48 and 50 in a plane with the top surface of the longitudinal grid wires 28 and 30. This assures a level surface over the entire grid, since no part of the grid extends above the uppermost wires in the grid, which, in the embodiment illustrated, are the longitudinally extending grid wires 28, 30, 32 and 34.

The wedging action of the angularly disposed end sections of the coil-engaging formations on the longitudinal and transverse sets of wires results when the top convolutes 14*b* are engaged by these angularly disposed end sections of the formations. This engagement is assured in turn if the overall length of each coil-engaging formation, including the angularly disposed end portions and the rectilinear intermediate portion, is greater than $\sqrt{D^2 - S^2}$, where D is the diameter of the convolute of the coil spring to be engaged and S is the distance between the displaced portions of the adjacent parallel coil-engaging wires. In addition, the intermediate section of each coil-engaging formation should be of a length less than $\sqrt{D^2 - S^2}$. With this formulation in mind, if the distance between the longitudinal grid wires 28 and 30, and thus the distance between the formations 44 and 46, is 4 inches, and the diameter of the top convolute of the coil spring is 4.25 inches, then $\sqrt{D^2 - S^2} = \sqrt{18 - 16} = \sqrt{2} = 1.4142$ inches. Thus, the length of the coil-engaging formations 44 and 46 would be greater than 1.4142 inches, and the length of the intermediate sections 44*c* and 46*c* (which is the distance between the end sections 44*a* and 44*b*) would be less than 1.4142 inches. The same relationship would hold true for the formations 48 and 50 of the transverse grid wires 36 and 38.

In actual practice, the diameter of the top convolute 14*b* of the coil spring is maintained within a tolerance of between +⅜ and −⅛ of an inch. If the established diameter of the top convolute is 4¼ inches, the actual diameter could vary from 4⅛ to 4⅝ inches. If the distance between the grid wires 28 and 30 is 4 inches, the length of the coil-engaging formations should be greater than $\sqrt{(4\frac{5}{8})^2 - (4)^2}$ or about 2⅛ inches, and the length of the intermediate sections 44*c* and 46*c* should be less than $\sqrt{(4\frac{1}{8})^2 - (4)^2}$ or about 1 inch.

In the preferred embodiment, the distance between the adjacent coil-engaging pairs of longitudinal grid wires 28 and 30 is the same as the distance between the corresponding pairs of transverse grid wires 36 and 38, and thus the coil-engaging formations are of equal dimension. It is, in fact, preferred that the coil-engaging formations on all of the wires be of the same dimension, which may be computed from the foregoing formula.

When using the dimensional relationships of the formula, it will be apparent that the top convolute 14*b* of each coil will be wedged against the angularly disposed end sections of each coil-engaging formation, with the coil rigidly held in place under one corresponding pair of coil-engaging formations and over the other corresponding pair of coil-engaging formations. This wedging action will prevent any relative movement between the top coil convolute and the coil spring supporting grid structure 16. In this manner, the coil will be held even more rigidly than if it were clamped or held by wire or pigtail connections in the usual manner.

The assembly of the unit is facilitated to such extent that the operation can actually be accomplished by unskilled labor. This means that the components of the spring unit assembly may be shipped separately, thus providing for a more efficient and economical manner of packaging and shipping. For example, from 6 to 12 coil spring supporting grid structures may be packaged in a single relatively compact package, and the conically shaped coil springs can be nested and shipped in another package, thereby saving approximately 50% or more of the volume of packaging which would be required for shipping assembled spring units.

Figure 3:
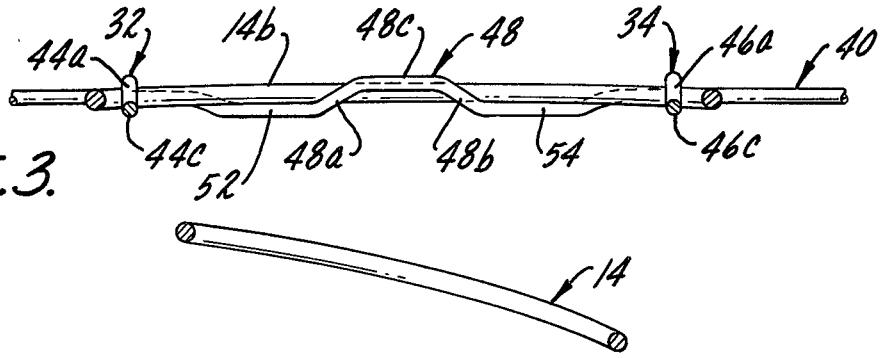
FIG. 3 is a further enlarged sectional view of a portion of the spring unit assembly taken substantially along line 3—3 of FIG. 1.
Figure 5:
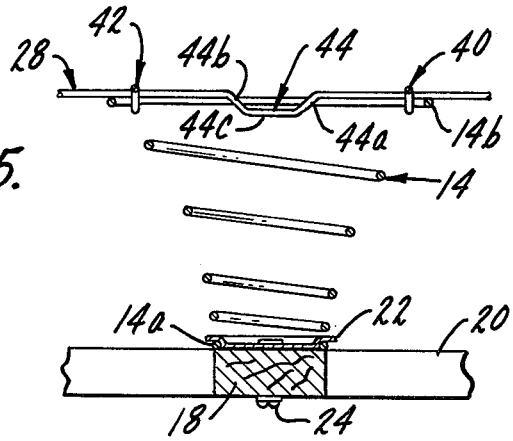
FIG. 5 is a side elevational view, partially in section, of a box spring unit assembly incorporating the grid structure of this invention at the top.

The entire spring unit may then be easily assembled at the factory by attaching the coils to the bottom frame 12 by any suitable means, including the use of a disc 22 and penetrating fastener 24, as previously described. The top convolute of each coil spring 14 may then be attached to the coil spring supporting grid structure 16, as shown in FIG. 4, by inserting each coil top convolute under the corresponding downwardly depending formation 44 and over the corresponding upwardly extending formations 48 and 50, then, by simply placing a tool, such as a broad-bladed screwdriver having a short handle, between the downwardly depending formation 46 and the top convolute 14*b* and pushing the handle down through the center of the convolute to spring the engaged portion of the convolute under the downwardly depending formation 46, as viewed in FIG. 4. The wedging action of the formations 44, 46, 48 and 50 will center the top convolute which will be tightly engaged by these formations on their angularly shaped end sections. This engagment is shown in FIGS. 1, 3 and 5.

It will be understood that the foregoing description has been given only by way of example and that various changes and modifications in the structural details may be undertaken without departing from the spirit and scope of the invention, as defined by the appended claims.

What is claimed is:

1. A coil spring supporting grid structure adapted for snap-in inter-connection with a plurality of coil springs to form a spring unit assembly, said grid structure comprising a set of longitudinal and a set of transverse wires fixedly joined together at their intersections to define a substantially planar grid, said wires having coil-engaging formations intermediate said intersections extending transversely with respect to said grid plane, with each corresponding pair of coil-engaging formations of adjacent longitudinal wires extendng in one direction with respect to said grid plane, and each corresponding pair of coil-engaging formations of adjacent transverse wires extending in the opposite direction with respect to said grid plane, with the coil-engaging formations of at least one of said sets of wires being adapted to engage the interior of an end convolution of a coil spring, whereby the end convolution of a coil spring may be snapped in place under one corresponding pair of coil-engaging formations and over the other corresponding pair of formations.

2. The structure of claim 1 wherein said coil-engaging formations are displaced portions of said wires, and the coil-engaging formation of both of said sets of wires are adapted to engage the interior of an end convolution of a coil spring.

3. The structure of claim 1 wherein the distance between at least certain adjacent parallel coil-engaging wires is less than the diameter of the end convolute of the coils to be engaged, whereby the wires will extend across portions of the coils.

4. The structure of claim 1 wherein said wires are welded together at their intersections.

5. The structure of claim 1 wherein the coil-engaging formations of one set of wires extend in one direction substantially perpendicularly with respect to said grid plane and the coil-engaging formations of the other set of wires extend in the opposite direction substantially perpendicular with respect to said plane.

6. The structure of claim 1 wherein said coil supporting grid structure further includes a border wire extending around the periphery of said structure, each of said longitudinal and transverse wires being attached to said border wire.

7. The structure of claim 1 wherein the spacing between the adjacent coil-engaging wires is substantially the same throughout the grid structure and all coil-engaging formation is substantially the same length.

8. The structure of claim 1 wherein at least one set of parallel wires is recessed on either side of each said formation to accommodate the intersecting portions of a coil spring convolute.

9. A coil spring supporting grid structure adapted for snap-in interconnection with a plurality of coil springs to form a spring unit assembly, said grid structure comprising a set of longitudinal and a set of transverse wires fixedly joined together at their intersections to define a substantially planar grid, said wires having coil-engaging formations intermediate said intersections extending transversely with respect to said grid plane, with each corresponding pair of coil-engaging formations of adjacent longitudinal wires extending in one direction with respect to said grid plane, and each corresponding pair of coil-engaging formations of adjacent transverse wires extending in the opposite direction with respect to said grid plane, whereby an end convolution of a coil spring may be snapped in place under one corresponding pair of coil-engaging formations and over the other corresponding pair of formations, said coil-engaging formations having opposed end sections which are angularly disposed with respect to both the grid plane and the direction of displacement and are adapted to wedgingly engage the coil spring's convolution.

10. The structure of claim 9 wherein the section of each coil-engaging formation intermediate said opposing end sections is rectilinear and substantially parallel to said grid plane.

11. The structure of claim 10 wherein the length of each coil-engaging formation is greater than the root of $\sqrt{D^2 - S^2}$; where D is the diameter of the convolute of the coil springs to be engaged and S is the spacing between the displaced portions of the adjacent parallel coil-engaging wires.

12. The structure of claim 11 wherein the section of each coil-engaging formation intermediate said end sections is rectilinear, substantially parallel to said grid plane and of a length less than the root of $\sqrt{D^2 - S^2}$.

13. A spring unite assembly comprising a plurality of coil springs arranged in a plurality of aligned longitudinal columns and transverse rows, coil spring supporting means connected to said coil springs at one side of said assembly and a coil spring supporting grid structure connected to said coil springs at the other side of said assembly, said grid structure comprising a set of longitudinal and a set of transverse wires fixedly joined together at their intersections to define a substantially planar grid, wires having coil-engaging formations intermediate said intersections extending transversely with respect to said plane, with each corresponding pair of coil-engaging formations of adjacent longitudinal wires extending in one direction with respect to said plane, and each corresponding pair of coil-engaging formations of adjacent transverse wires extending in the opposite direction with respect to said plane, with the coil-engaging formations of both sets of wires being adapted to engage the interior of an end convolution of a coil spring, whereby the end convolution of a coil spring may be snapped in place under one corresponding pair of coil-engaging formations and over the other corresponding pair of formations.

* * * * *